US008013537B2

(12) United States Patent
Summerland

(10) Patent No.: US 8,013,537 B2
(45) Date of Patent: Sep. 6, 2011

(54) LIGHTING SYSTEM POWER ADAPTOR

(75) Inventor: David Thomas Summerland, Old Dalby (GB)

(73) Assignee: Hold IP Limited, Isle of Man (GB)

( * ) Notice: Subject to any disclaimer, the term of this patent is extended or adjusted under 35 U.S.C. 154(b) by 1143 days.

(21) Appl. No.: 11/660,725

(22) PCT Filed: Aug. 8, 2005

(86) PCT No.: PCT/GB2005/003099

§ 371 (c)(1),
(2), (4) Date: Feb. 20, 2007

(87) PCT Pub. No.: WO2006/018604

PCT Pub. Date: Feb. 23, 2006

(65) Prior Publication Data

US 2008/0094423 A1 Apr. 24, 2008

(30) Foreign Application Priority Data

Aug. 20, 2004 (GB) ..... 0418600.3
Dec. 1, 2004 (GB) ..... 0426322.4

(51) Int. Cl.
*H05B 37/02* (2006.01)

(52) U.S. Cl. ..... 315/291; 315/307; 315/DIG. 4; 362/227; 362/228

(58) Field of Classification Search ..... 315/291, 315/294, 295, 297, 307, 308, DIG. 4; 362/227, 362/228, 231, 800; 361/600
See application file for complete search history.

(56) References Cited

U.S. PATENT DOCUMENTS

| | | | | |
|---|---|---|---|---|
| 5,121,287 | A * | 6/1992 | Lee | 361/600 |
| 6,093,983 | A * | 7/2000 | Singh | 307/125 |
| 7,038,399 | B2 * | 5/2006 | Lys et al. | 315/291 |
| 2004/0085030 | A1 | 5/2004 | Laflamme et al. | |
| 2004/0264187 | A1 * | 12/2004 | Vanderschuit | 362/235 |
| 2006/0002110 | A1 * | 1/2006 | Dowling et al. | 362/252 |
| 2006/0238136 | A1 * | 10/2006 | Johnson, III et al. | 315/185 R |

FOREIGN PATENT DOCUMENTS

| | | |
|---|---|---|
| EP | 0 574 993 A | 12/1993 |
| WO | WO 01/082657 A | 11/2001 |

* cited by examiner

*Primary Examiner* — Jacob Y Choi
*Assistant Examiner* — Ephrem Alemu
(74) *Attorney, Agent, or Firm* — Quine Intellectual Property Law Group, P.C.

(57) ABSTRACT

A power adaptor for a lighting unit, comprising an input for coupling to an electrical power supply and a controller adapted to monitor the input and operable to provide at least two independent electrical outputs; each output having a power level based on an amount of power available at the input. The independent electrical outputs may be used to supply and control an intensity and/or color characteristic of a solid state lighting unit; comprising at least two separately controllable colored emitters.

34 Claims, 3 Drawing Sheets

LIGHTING SYSTEM POWER ADAPTOR

This application is a national phase entry in the United States under 35 U.S.C. §371 from International Application Number PCT/GB2005/003099, which has an international filing date of Aug. 8, 2005, and which designated the United States of America, which claims priority to and benefit of Great Britain Patent Application 0418600.3, filed Aug. 20, 2004, and claims the benefit of Great Britain Patent Application 0426322.4, filed Dec. 1, 2004, the disclosure of which is incorporated herein by reference in its entirety for all purposes.

The present invention relates to lighting systems and lighting controllers, and in particular to power adaptors for solid state lighting units.

Incandescent lighting units are used widely for internal lighting in buildings and other accommodation, in particular where dimmable lighting is required.

More recently, solid state lighting units, such as those using light emitting diodes (LED's), have become popular for providing so-called 'mood' lighting. By providing three different colours of light emitting diodes (typically RGB—red, green and blue), it is readily possible to control an overall colour of illumination from the LED lighting units by independently varying intensity of output from each one of the different colour groups.

It is widely recognised however that LED lighting units do not generally replace conventional incandescent and fluorescent lighting units as they are generally more expensive and relatively inefficient at producing high intensity white light. Therefore, LED lighting units are generally installed and used as an adjunct to conventional lighting.

Conventionally, LED lighting units require separate controls and switched mains supplies from standard lighting units so that the standard lighting can be turned off to allow the colour changeable LED lighting to be used. Therefore, duplicate switches to allow full isolation of the individual lighting units, and dual controls for intensity and/or colour, may also be required.

Installation of separate wiring circuits and switching units for both incandescent lighting and for solid state lighting increases installation costs, especially where LED lighting is being added to an existing installed lighting system. In many domestic environments (e.g. small rooms such as kitchens, bedrooms and bathrooms), it is often considered aesthetically undesirable to provide multiple switch plates on walls for separate lighting controls.

It is an object of the present invention to provide a power adaptor which allows LED lighting to be used with an existing mains power supply and domestic wiring circuit, to avoid the need to install separate wiring circuits and switching units for both incandescent lighting and for solid state lighting. It is a further object of the invention to provide a system that enables control of two such disparate lighting systems using a single existing wiring circuit. It is a further object of the invention to provide a system that enables use of a unitary conventional dimmer control switch for control of both incandescent and LED lighting.

Some or all of the above objects are provided by embodiments of the present invention as described hereinafter.

According to one aspect, the present invention provides a power adaptor for a lighting unit, comprising:

- an input for coupling to an electrical power supply; and
- a controller adapted to monitor the input and operable to provide at least two independent electrical outputs, each output having a power level based on an amount of power available at the input.

According to another aspect, the present invention provides an adaptor for supplying power to a lighting unit, comprising:

- a sensing means for monitoring a duty cycle of an input received from a main power supply; and
- a control means responsive to the input duty cycle and operable to provide at least two independent electrical outputs, each having a duty cycle based on the input duty cycle.

According to a further aspect, the present invention provides a lighting system comprising:

- a solid state lighting unit including at least two separately controllable light emitters of different colours;
- a lighting controller for controlling the output of an electrical power supply for the lighting unit; and
- a power adaptor including:
  - an input for receiving the output of the electrical power supply; and
  - a controller adapted to monitor the input and operable to provide at least two independent electrical outputs, each output having a power level based on an amount of power available at the input;

wherein each light emitter is adapted to receive a respective one of the electrical outputs to control an intensity and/or variable colour characteristic output of the lighting unit.

Embodiments of the present invention will now be described by way of example and with reference to the accompanying drawings in which.

Figure 1:
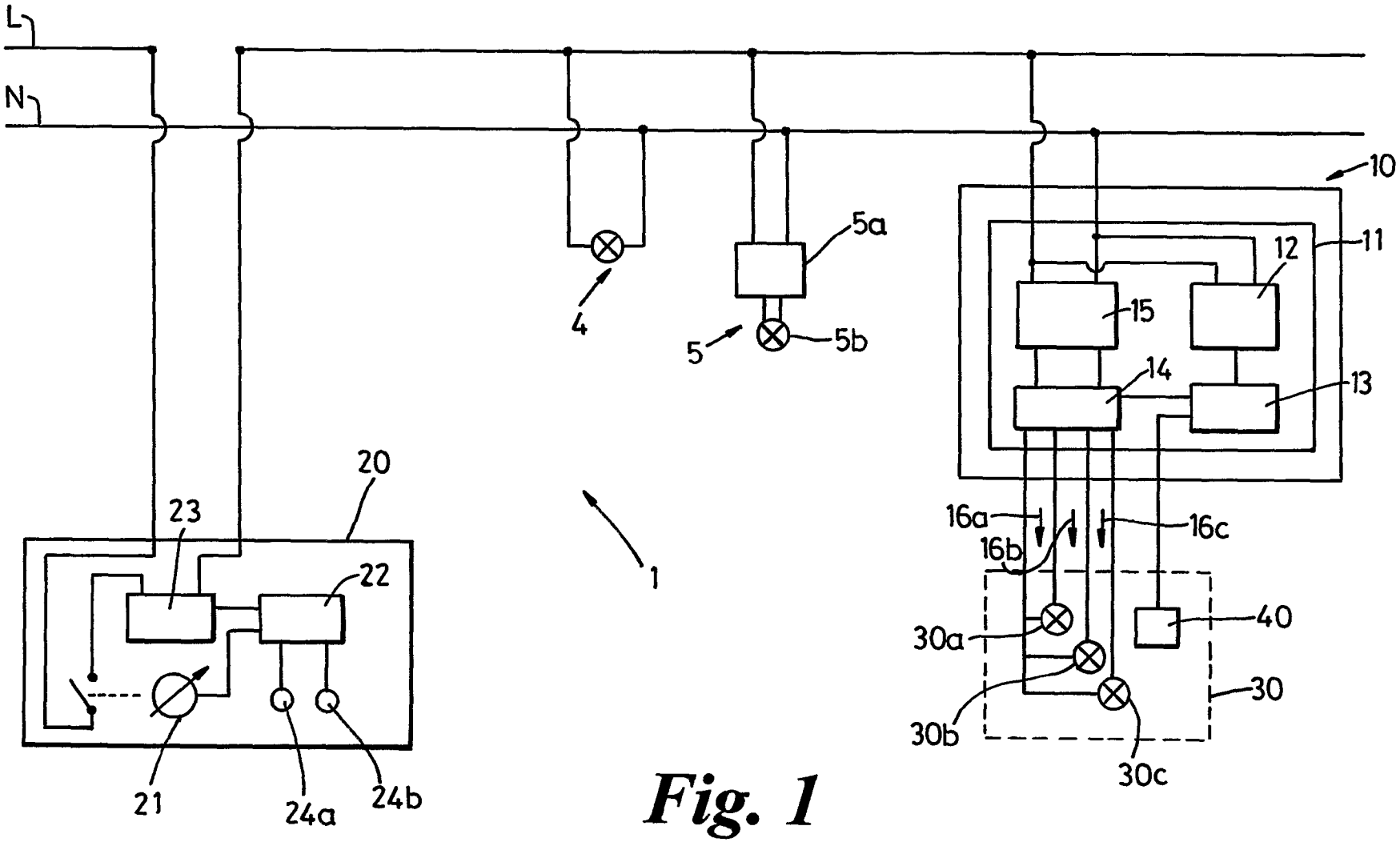
FIG. 1 is a schematic diagram of a lighting system according to a preferred arrangement.

With reference to FIG. 1, there is shown a lighting system 1 according to a preferred arrangement. The lighting system 1 includes both incandescent lighting units 4, 5 and a solid state lighting unit 30. A lighting controller 20 provides for connection of the incandescent lighting units 4, 5 to a mains supply L, N. In the schematic of FIG. 1, lighting unit 4 is a mains voltage incandescent lighting unit and lighting unit 5 is a low voltage halogen lighting unit comprising transformer 5*a* and at least one low voltage bulb 5*b*. The solid state lighting unit 30 is a colour changeable LED unit preferably comprising at least two differently coloured emitters. Most preferably, the LED unit comprises three coloured emitters 30*a*, 30*b*, 30*c* in a colour array, one each of red, green and blue LEDs.

It is to be appreciated that in other arrangements, the power supply for the lighting system 1 need not be a mains power supply, and instead any other suitable supply may be used, in particular, the supply could be 12 VDC (as typically used on a boat and in camping vehicles), whereby L would be +12V and N 0V. Alternatively, the power supply lines L, N could be taken from an existing AC low voltage transformer (not shown), of a kind used with low voltage halogen or similar lighting, which typically provide 12 VAC.

Associated with the solid state lighting unit 30 is a power adaptor 10, which connects to the mains supply L, N via the lighting controller 20. The power adaptor 10 supplies electrical power to, and controls the output of, the solid state lighting unit 30. In preferred arrangements, the power adaptor 10 and solid state lighting unit 30 are remotely located and are connected by a hardwire electrical connection, while in alternative arrangements, the power adaptor 10 may be integral to the solid state lighting unit 30, e.g. enclosed within a common housing.

It is to be appreciated that there may be any number of incandescent 4, 5 and/or solid state lighting units 30 in the lighting system 1, and that there will be preferably one power adaptor 10 per solid state lighting unit 30.

The two different lighting types—incandescent lighting units 4, 5 and solid state lighting unit 30—have significantly different electrical characteristics. The first type of lighting units have higher power requirements and are controllable in intensity by reducing the mains power that can be drawn by the lighting unit, conventionally by control of the voltage duty cycle of the mains supply. Preferably, this is done with phase-controlled variation in the voltage using a triac or thyristor dimming circuit.

By contrast, solid state lighting units have low power requirements and the intensity of individual solid state devices, such as the LEDs 30*a*, 30*b*, 30*c*, in a colour array is generally controlled by pulse width modulation of a constant low voltage supply. The intensity of different colour LEDs within the array may be independently controlled in order to effect a change in the colour characteristic output of the lighting system, or may be jointly controlled to effect a change in intensity only.

The power adaptor 10 actively monitors the amount of available power at the input of the adaptor via a controller 11. As shown in FIG. 1, the input is connected to the mains supply L, N via the lighting controller 20, which is used to produce a phase-controlled variation in the output of the mains supply L, N. This may be achieved by controllably 'chopping' the sinusoidally varying waveform, using conventional techniques, so as to alter the mains supply duty cycle. The upshot of this is to make available a range of power at the input of the adaptor 10, such that a short duty cycle corresponds to a low power level and a relatively higher duty cycle corresponds to a high power level.

A power monitoring circuit 12 in the controller 11 either directly measures the available input power or monitors the variations in the output of the mains supply (e.g. by timing the triac firing) or both, to determine an input duty cycle and corresponding power level. The output of the monitoring circuit 12 is preferably an isolated analogue signal in the range of 0-5 volts, which may be calibrated such that, substantially 0 V corresponds to a short (or zero) duty cycle and substantially 5 V corresponds to a high duty cycle, e.g. 100% of mains voltage duty cycle, respectively. Alternatively, the output of the power monitoring circuit 12 may be a digital signal which is encoded as a function of the input duty cycle. A further possibility is that the output could be a reduced amplitude representation of the input, as passed through a reducing transformer.

The analogue signal is converted into a digital input signal, using conventional means (not shown), and is supplied to a processor 13 in the controller 11. The processor 13 is programmed to output a control signal which is based on the input duty cycle, or power available, at the input of the adaptor 10. The control signal provides instructions to an output power module 14, within the controller 11, to effect a change in the colour characteristic output of the solid state lighting unit 30, or to effect a change in intensity, or both.

The power output module 14 preferably provides at least two, and most preferably three, independent electrical outputs 16*a*, 16*b*, 16*c* for control of the LEDs 30*a*, 30*b*, 30*c* in the colour array of the solid state lighting unit 30. Each of the electrical outputs 16*a*, 16*b*, 16*c* is separated controllable and has a power level based on an amount of power assailable at the input of the adaptor 10. Preferably, the power level of each independent electrical output 16*a*, 16*b*, 16*c* is a function of the power presently available at the input, and/or a function of a lighting profile that is selected as a function of a power historically available at the input, as will become apparent later when the profiles are discussed in greater detail.

Preferably, the independent electrical outputs 16*a*, 16*b*, 16*c* are pulse width modulated signals having substantially constant current or voltage levels, which control the amount of power supplied to each of the LEDs 30*a*, 30*b*, 30*c* in the colour array by varying the duty cycle of the electrical output 16*a*, 16*b*, 16*c*, in accordance with a transfer characteristic which is a function of the power available at the input of the adaptor 10.

A power regulator 15 is included within the controller 11 and is coupled to the input as shown in FIG. 1. The power regulator 15 supplies electrical power to the power output module 14, based on an amount of power available at the input. The function of the power regulator 15 is to supply a substantially constant output to the power output module 14 for as wide a range of available input power as possible.

Preferably, the power regulator 15 supplies a constant output over a range of approximately 20% to approximately 100% of the mains voltage duty cycle as measured at the input of the adaptor 10. The power level of the constant output over the this range is sufficient to provide power for operation of the solid state lighting unit 30, such that the LEDs 30*a*, 30*b*, 30*c* can be operated at their maximum light output intensity.

For input duty cycles below approximately 20% of the mains voltage duty cycle, the power regulator 15 does not receive sufficient power in order to maintain a constant output and therefore supplies a relatively lower, variable output to the power output module 14, which corresponds to an available power which can only dimly light the LEDs 30*a*, 30*b*, 30*c*. By 'dimly light' we mean that the light output is sufficiently small to have little or no practical effect on lighting a room in which the solid state lighting unit 30 is installed.

It is to be appreciated that the range of input duty cycle corresponding to the constant output is not limiting, and that the power regulator 15 may be configured to supply a constant output over any suitable range of input duty cycle, depending on the power requirements of the solid state lighting unit 30.

The adaptor 10 is operable to control an overall output intensity and/or colour characteristic output of the solid state lighting unit 30 by way of a suitable lighting profile e.g. one which has a linear or a non-linear transfer characteristic as a function of the available power or duty cycle at the adaptor input. The transfer characteristic serves to define the relationship between the available input power and the output levels of the independent electrical outputs 16*a*, 16*b*, 16*c*. Preferably, the processor 13 is programmed with a plurality of such lighting profiles, each one giving rise to a particular lighting effect having a preferred intensity and/or colour characteristic output.

To implement one of the lighting profiles, the processor 13 modifies the control signal to the power output module 14, which in turn provides corresponding electrical outputs 16*a*, 16*b*, 16*c* to effect the particular transfer characteristic of the selected profile. A different transfer characteristic may be applied to each electrical output 16*a*, 16*b*, 16*c* according to the overall lighting effect to be achieved. Preferably, the power output module 14 modifies the duty cycles of the pulse width modulated signals to each of the LED emitters 30*a*, 30*b*, 30*c* in the colour array which are to provide a coloured light component and contribution to intensity to the overall lighting effect.

The processor 13 is programmed to sequentially select a successive one of the lighting profiles whenever the power available at the input of the adaptor 10 (as indicated by the input duty cycle) is at a level which is insufficient to provide power for operation of the solid state lighting unit 30. This level corresponds to a power level at which the LEDs 30*a*, 30*b*, 30*c* are effectively off, and is herein referred to as the 'minimum power level'.

Preferably, the minimum power level is non-zero, since a zero power level (and hence zero duty cycle) is regarded by the processor 13 as a re-set signal, causing the processor 13 to re-set the order of profile selection so as to start again from the first programmed profile.

In alternative arrangements, the processor 13 could be programmed to remember the last implemented profile in a non-volatile memory, so that when the power adaptor 10 is turned on from being off, the last profile may be selected in preference to the first programmed profile.

It is to be appreciated that the processor 13 may be programmed to sequentially select a profile in response to any specific available power level, for example, the next profile could be selected when the available power at the adaptor input corresponds to substantially 100% mains voltage duty cycle i.e. corresponding to maximum output intensity of the solid state lighting unit 30. Alternatively, the processor 13 may be programmed to respond to any 'sudden' change in available input power, e.g. by quickly rotating a dimmer control switch back and forth etc. within a prescribed time interval.

The processor 13 preferably contains 8 lighting profiles each giving rise to a particular lighting effect or 'mood' lighting. Of course, it is to be appreciated that the processor 13 may contain any number of profiles depending upon the particular lighting system and environment in which it is intended to be used.

Preferably, each lighting profile (except the default profile) includes a transfer characteristic which causes the processor 13 to instruct the power output module 14 to produce a colour characteristic output of the solid state lighting unit 30 which is (i) contrasted towards substantially white when the input duty cycle is in the range of approximately 35% to approximately 100% of mains voltage duty cycle, and (ii) coloured light when the input duty cycle is in the range of approximately 20% to approximately 35% of mains voltage duty cycle.

By way of illustration, the transfer characteristics of exemplary profiles can be configured so that the following example colour characteristic outputs are produced when the input duty cycle is increased from a low duty cycle to a high duty cycle:

(i) dim green to bright green (using only a single LED) and then to white (using all 3 LEDs)

(ii) dim red to bright red (using only a single LED) and then to white (using all 3 LEDs)

(iii) dim yellow to bright yellow (using 2 LEDs) and then to white (using all 3 LEDs)

(iv) gradual transition through the spectral range—dim red to bright violet (using 1, 2 or 3 LEDs as appropriate) and then to white (using all 3 LEDs).

It is also possible to configure the transfer characteristics of the profiles so that the colour characteristic output is different when going from bright to dim, than when going from dim to bright as just illustrated. Hence, an exemplary profile may, go from dim blue to bright blue then to white with increasing input duty cycle, and go from white to bright orange to dim orange as the duty cycle decreases.

In the case of the default profile, which is always selected whenever the power adaptor 10 is first turned on, the colour characteristic output is maintained at substantially white light throughout the range of input duty cycle.

It is to be appreciated that the transfer characteristics can be modified to adapt the colour characteristic output to any suitable range, or ranges, of input duty cycle. For example, the transfer characteristics could enable all colours, and colour combinations, to be available within a single lighting profile with increasing (and decreasing) input dutch cycle.

Referring again to FIG. 1, the lighting controller 20 is preferably in the form of a wall switch plate providing one rotary control knob 21 for providing variable control of the output of the mains supply L, N. The control knob 21 acts as both an intensity control and as a colour (or 'mood') control for the solid state lighting unit 30. A processor 22, e.g. a microprocessor, monitors the position of the control knob 21 between the extremities of its range and outputs a corresponding signal to a triac and/or thyristor dimming circuit 23, thus providing a phase-controlled, variable-power electrical output on the mains supply lines L, N.

Hence, preferably at a first end point of the control knob range the modified electrical output corresponds to a low, or zero, power level (giving rise to low or zero duty cycle) and at a second end point of the range, the output corresponds to a high power level (e.g. 100% of mains voltage duty cycle).

Preferably, the control knob 21 incorporates an isolation switch (not shown) for isolating the modified electrical output, e.g. a push switch operated by pushing the control knob 21 on its axis, or a limit switch actuated by turning the knob to one extremity of its range, in accordance with known dimmer switch operation.

In addition to controlling the output of the electrical power supply by rotation of the control knob 21, a wireless input signal may be supplied to a sensor 24*a*, 24*b* connected to the processor 22. The signal instructs the processor 22 to modify the electrical output by encoding the output in accordance with a pre-set sequence of output power levels. The encoding is achieved by controlling the dimming circuit 23 such that the duty cycle of the electrical output is modified accordingly. The pre-set sequence includes one or more power levels which correspond to the minimum power level (i.e. when the LEDs 30*a*, 30*b*, 30*c* are essentially off) and includes at least one power level corresponding to a power level when the LEDs 30*a*, 30*b*, 30*c* are on.

The result of the encoding is to automatically produce an electrical output substantially identical in form to an output which would have been produced had the control knob 21 been correspondingly rotated, either once, or repeatedly, as the case may be. In this way, the power available at the input of the adaptor 10 can be varied in a manner which causes the processor 13 to select a particular lighting profile based on the number of occurrences of the minimum power level in the pre-set sequence.

Preferably, the wireless input signal may be either electromagnetic or acoustic in nature, such as infra red, radio or ultrasonic, and the lighting controller 20 may include either an electromagnetic sensor 24*a* or an acoustic sensor 24*b*, or both, and would be preferably operated by a suitable hand-held remote control.

The remote control would also preferably allow the output intensity of the solid state lighting unlit 30 to be controllably varied, without causing a change in the lighting profile.

It is to be appreciated that although the control knob 21 is described as having a rotary operation, the control knob 21 may also be in the form of a slidable switch or other device capable of providing continuous or quantised variable control over a range between two end points e.g. separate 'up' and 'down' buttons providing incremental control between the end points.

The control knob 21 may also be in the form of a pull cord, as typically used in bathroom style light switches and dimmers. Of course, it should be noted that some pull cords only give rise to a successive reduction in light level (i.e. dim down) and not to incremental increases in light level (i.e. dim up). For such cords, selection of profiles could be achieved by temporarily switching the lighting controller 20 off for a brief period, and relying on a sufficient charge in the processor power circuit to maintain the processor during the operation. This could be based on nano-watt pic technology.

The operation of a lighting system as shown in FIG. 1, will now be described starting at a time when the lighting controller 20 is turned off (i.e. the electrical output is isolated). When the controller 20 is off, both the incandescent lighting units 4, 5 and the solid state lighting unit 30 are off and hence neither provides any illumination. As the duty cycle increases, with rotation of the control knob 21, the power available at the input of the adaptor 10 reaches, or exceeds, the minimum power level. The power monitoring circuit 12, in the controller 11, monitors this duty cycle and provides a corresponding signal to the processor 13. Since the power adaptor 10 has switched on from being off, the processor 13 selects the first programmed lighting profile, which preferably, corresponds to a substantially white colour characteristic output (i.e. the preferred default profile). At this time, the power output module 14 provides the LEDs 30*a*, 30*b*, 30*c* with independent electrical outputs 16*a*, 16*b*, 16*c* which cause the respective LEDs to dimly light. Each time the power adaptor 10 is turned off and then on again, a white profile is always preferably selected.

When the control knob 21 is rotated such that the input duty cycle corresponds to approximately 20% of the mains voltage duty cycle, the power regulator 15, in the power adaptor 10, supplies a constant output to the power output module 14 and independent electrical outputs 16*a*, 16*b*, 16*c* cause the LEDs 30*a*, 30*b*, 30*c* to brighten from a dimly lit state to a bright state. By 'bright state' we mean that the solid state lighting unit 30 is able to provide an appreciable amount of illumination to a room in which the lighting unit 30 is installed.

At about the same time, the incandescent lighting units 4, 5 may become dimly lit, however due to their higher power requirements, their contribution to any overall illumination is negligible. By 'negligible', we mean that the light output is sufficiently small to have little or no practical effect on lighting a room in which the lighting units 4, 5 are installed, such that the solid state lighting unit's output will dominate any lighting.

Further rotation of the control knob 21, increases the power available to the incandescent lighting units 4, 5 which begin to brighten, while the power output module 14 in the adaptor 10 continues to receive a constant output from the power regulator 15. However, the processor 13 in the controller 11 responds to the increase in input duty cycle and instructs the power output module 14 to increase the duty cycle of the independent electrical outputs 16*a*, 16*b*, 16*c* to each of respective the LEDs 30*a*, 30*b*, 30*c*, to increase the overall output intensity of the solid state lighting unit 30. Note however, since the processor 13 is still implementing the transfer characteristic of the first lighting profile, the output colour of the solid state lighting unit 30 remains substantially white.

When the control knob 21 is turned to an intermediate point between its first and second end points, corresponding to a duty cycle of approximately 35% mains voltage duty cycle (preferably at approximately 35% of the control knob range), the colour characteristic output of the LED colour array remains as substantially, white, and the output intensity attains its maximum output intensity. Further increases in duty cycle cause only the incandescent units 4, 5 to increase their output intensity until their maximum output is attained at around a duty cycle of substantially 100% mains voltage duty cycle.

As the control knob 21, is returned back towards the first end point of its range, the intensities of the incandescent lighting units 4, 5 begin to decrease. The colour output of the solid state lighting unit 30 remains substantially white, and the overall output intensity of the LEDs 30*a*, 30*b*, 30*c* dominates over the incandescent lighting units 4, 5, which become dimmer with diminishing duty cycle. The solid state lighting unit 30 continues to output bright, substantially white, light at a time when the incandescent lighting units 4, 5 are dimly lit, until the input duty cycle falls below approximately 20% of the mains voltage duty cycle, at which point the power made available by, the power regulator 15 is simply too low for the power output module 14 to maintain the independent electrical outputs 16*a*, 16*b*, 16*c* and the LEDs 30*a*, 30*b*, 30*c* begin to dim until the minimum power level is reached. At this time the processor 13 instructs the output module 14 to turn the LEDs 30*a*, 30*b*, 30*c* completely off.

If however, before the LEDs 30*a*, 30*b*, 30*c* are turned off, the control knob 21 is rotated towards its second end point again, the previous colour and intensity sequence will be repeated as before, without there being any change in the selected lighting profile.

Provided the power adaptor 10 is not turned off, the processor 13 will sequentially select the next lighting profile in the preferred sequence of profiles, after the LEDs 30*a*, 30*b*, 30*c* are turned off.

In the case of a pull cord control knobs profile selection may be effected by an intermittent interruption of electrical power to the lighting controller 20, as discussed previously.

Now, when the control knob 21 is turned away from its first end point this time, the solid state lighting unit 30 outputs a colour characteristic which is preferably a coloured light, e.g. orange, when the input duty cycle corresponds to a power level above the minimum power level. As the input duty cycle increases to approximately 20% of the mains voltage duty cycle, with rotation of the control knob 21, the LED colour array brightens considerably, as the power regulator 15 begins to provide a constant output to the power output module 14. With increasing input duty cycle, corresponding to further rotation of the control knob 21, the output intensity of the LED colour array increases but the colour characteristic remains substantially unaltered e.g. simply a brighter orange output. This coloured light output is maintained between an input duty cycle of approximately 20% to approximately 35% mains voltage duty cycle. As before, the incandescent lighting units 4, 5 begin to increase in brightness throughout this time, but the output intensity of the solid state lighting unit 30 dominates over the output intensity of the incandescent lighting units 4, 5. However, as the input duty cycle increases further, above approximately 35% mains voltage duty cycle, the colour characteristic output begins to be contrasted towards a substantially white light, as the processor 13 instructs the power output module 14 to provide an independent electrical output 16*a*, 16*b*, 16*c* to each LED 30*a*, 30*b*, 30*c* in the colour array, in accordance with the transfer characteristic of the selected lighting profile.

Hence, as the input duty cycle increases from approximately 35% towards approximately 100% of mains voltage duty cycle, the output of the solid state lighting unit 30 remains at maximum output intensity, while maintaining a substantially white colour characteristic output. All the while, the intensities of the incandescent lighting units 4, 5 have been increasing accordingly, until they too attain their maximum output intensity at around the same time.

As the input duty cycle is decreased, by turning the control knob 21 back towards its first end point, the intensities of the incandescent lighting units 4, 5 begin to decrease, with the former lighting unit 30 maintaining a substantially white colour characteristic output. With further decreasing duty cycle, i.e. from approximately 35% mains voltage duty cycle, the colour characteristic output of the LED colour array begins to contrast away from substantially white and towards the previous colour e.g. orange, which is maintained until the duty cycle falls to a power level corresponding to the minimum power level, at which time the processor 13 instructs the power output module 14 to turn off the LEDs in the colour array.

If the control knob 21 is subsequently turned away from its first end point again, without the power adaptor 10 having been turned off, the next lighting profile will be selected by the processor 13 and so on, until the lighting controller 20 is turned off and the processor profile sequence is re-set.

Although the operation of the lighting system 1 has been described in relation to manual control of the lighting controller 20, operation may also be effected by wireless control as described earlier, such that a particularly preferred lighting profile may be selected by providing an encoded electrical output to the input of the adaptor 10, thereby simulating rotation of the control knob 21 an appropriate number of times.

It is to be appreciated that the operation of the lighting system 1 is the same regardless of whether incandescent lighting units 4, 5 are included or not, and that the presence of the units 4, 5 does not effect the operation of the power adaptor 10 and solid state lighting unit 30.

A number of modifications may be made to the embodiments described in connection with FIG. 1.

Figure 2:
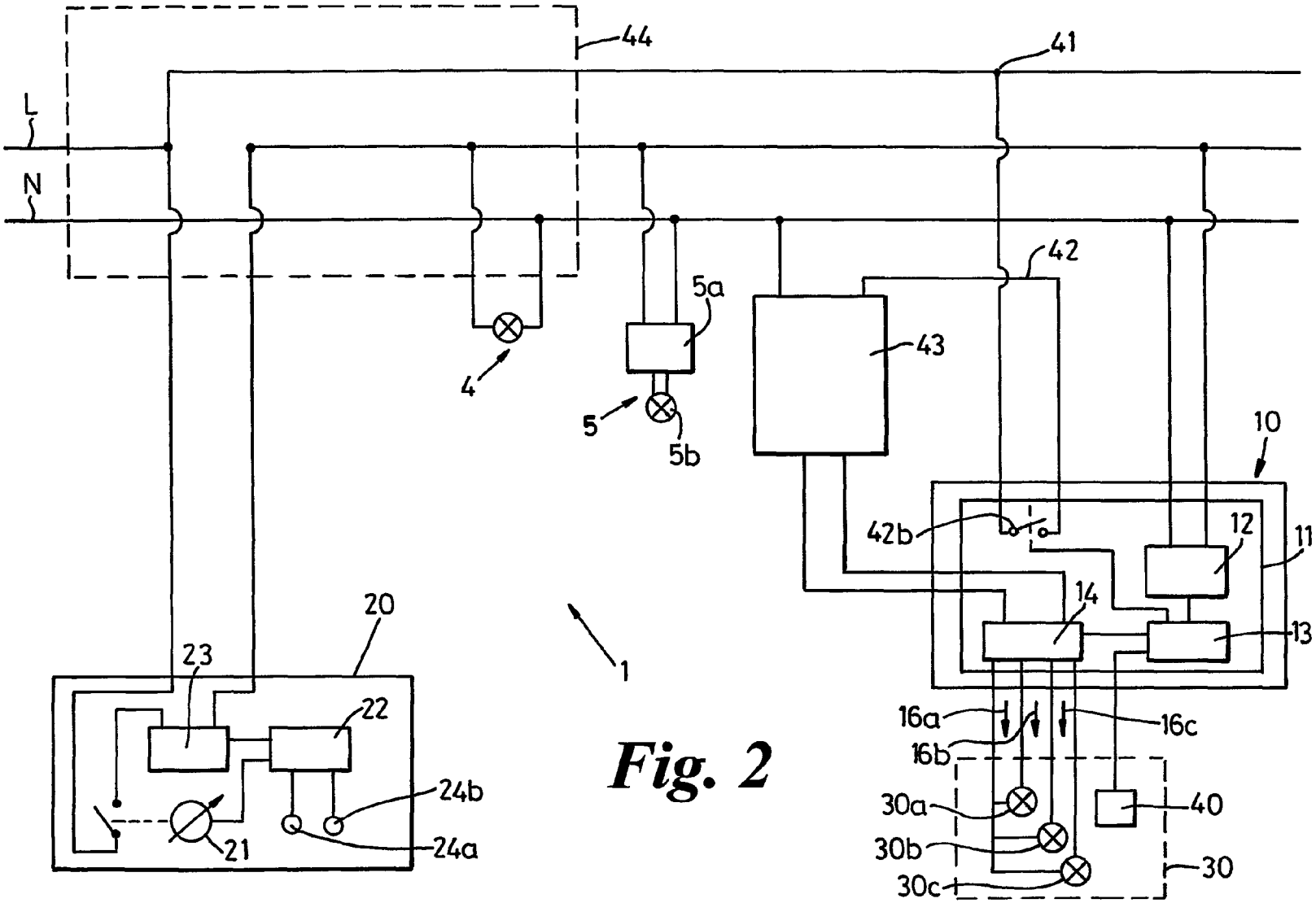
FIG. 2 is a schematic diagram of a lighting system according to another preferred arrangement.

Referring to FIG. 2, there is shown another preferred arrangement of a lighting system according to the present invention. In this arrangement, the power regulator is replaced by a conventional DC power supply 43, which is preferably separate from the power adaptor 10. The power supply 43 is connected across the mains supply L, N via a switch 42*b* controlled by the processor 13 in controller 11. Preferably, the switch 42*b* is a conventional mains rated switching device, such as a relay, triac or thyristor.

The power supply 43 preferably connects to the live power supply line L in parallel with the lighting controller 20, so that the supply is able to receive approximately 100% of the mains duty cycle whenever it is connected to the live line L. Hence, the power supply 43 does not receive the phase-controlled variation in the output of the mains supply produced by the lighting controller 20.

The output of the power supply 43 is used to provide a constant electrical power to the power output module 14 within the controller 11, whenever the power supply 43 is connected to the mains supply L, N. The processor 13 is programmed to operate switch 42*b* based on the input duty cycle, or power available, at the input of the adaptor 10, as measured by the power monitoring circuit 12, as described previously. When the input duty cycle is below approximately 20% of the mains voltage duty cycle, the switch 42*b* is open and therefore the power supply 43 is unable to provide power to the power output module 14. Hence, LEDs 30*a*, 30*b*, 30*c* in solid state lighting unit 30 are not lit.

However, when the input duty cycle increases above approximately 20% of the mains voltage duty cycle, the processor 13 operates switch 42*b* so that the power supply 43 is connected to the mains supply L, N, thereby making electrical power available to the power output module 14—allowing the LEDs 30*a*, 30*b*, 30*c* to light in accordance with the selected lighting profile.

The operation of the lighting controller 20 and power adaptor 10, in respect of the output lighting and colour characteristics of the solid state lighting unit 30, is equivalent to that described in relation to previously preferred arrangements, and is not repeated for brevity. The only difference is that, as the input duty cycle decreases to approximately 20% of the mains voltage duty cycle, the processor 13 acts to disconnect the power supply 43 from the mains supply L, N, thereby turning the LEDs 30*a*, 30*b*, 30*c* completely off.

The above preferred arrangement is found to be particularly suited, although not exclusively, for implementation into lighting systems comprising one or more ceiling mounted incandescent lighting units, such that adaptor 10, solid state lighting unit 30 and power supply 43 may all be mounted in close proximity to an incandescent lighting unit, e.g. 4, mounted by way of a conventional ceiling rose, illustrated as ghost lines 44 in FIG. 2.

Figure 3:
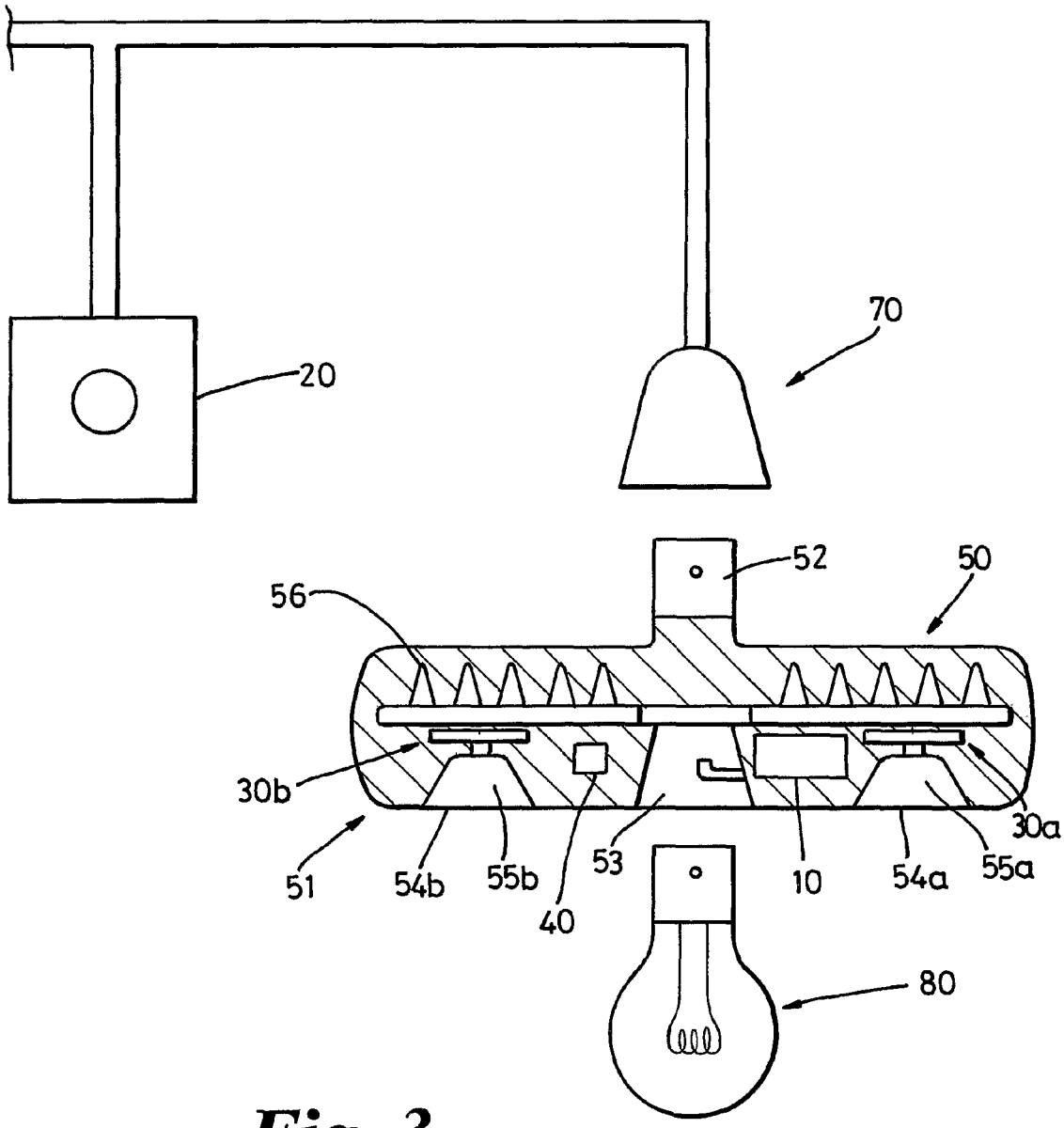
FIG. 3 is a schematic diagram of a lighting system showing in side cross-section a preferred lighting unit arrangement.

In a particularly preferred arrangement of the present invention, as shown in FIG. 3 the power adaptor 10 and solid state lighting unit 30 may be enclosed within a common housing 51 of a plug-in fitting 50, that is preferably designed to be installed into a standard light socket, such as a pendant 70, via an Edison screw or preferably a bayonet fitting 52. The housing 51 is preferably substantially toroidal in form, having a central hub (not shown), connected by radial spokes to the body of the torus, supporting a male component of a bayonet fitting 52, for insertion into a standard light socket 70. A female component of a bayonet fitting 53 (or Edison screw) receives an incandescent light source 80, e.g. a conventional light bulb. The housing 51 may be made from any suitable electrically insulating material, and is preferably plastic.

The LEDs 30*a*, 30*b*, 30*c* (only the first two are shown) are mounted within the housing 51, so that light from each emitter is able to emerge from respective apertures 54*a*, 54*b* in an outwardly facing surface of the housing 51. Preferably, the outwardly facing surface is adjacent the female component of the bayonet fitting 53 or screw, so that light from the emitters (and the incandescent light source 80) may be emitted in substantially the same direction. In preferred arrangements, the LEDs 30*a*, 30*b*, 30*c* are disposed within the housing 51 so that their angular separation (about the pendant axis) is approximately 120 degrees apart, although any suitable angular and/or spatial separation in the plane of the outwardly facing surface may be adopted.

To increase the light output efficiency of the LEDs, each emitter is preferably provided with a substantially conical reflector 55*a*, 55*b* as conventionally used in lighting devices.

Preferably, to assist with heat dissipation from the power adaptor 10, one or more conventional heat sinks 56 are provided, which minimise, or prevent, the risk of the plug-in fitting from overheating during continuous periods of use.

It is to be appreciated that the plug-in fitting 50 may be installed into any suitable standard light socket, such as in a table lamp, upwardly standing lamp or wall fixture, and is not limited to downwardly facing ceiling sockets. Moreover, the shape of the housing may take the form of any suitable 3-dimensional geometric shape, including flattened discs, cuboid and pyramidal etc.

The use of a plug-in fitting 50 is advantageous, as the fitting may be simply installed by non-specialist technicians, such as typical homeowners, without the need for re-wiring of existing electrical connections. Moreover, the fitting can be conveniently located, and re-located, within any desired room of the home, provided a suitable lighting controller 20 is available in that room i.e. standard mains dimmer switch, to thereby permit a particular 'mood' lighting to be selected.

Although the preferred arrangements require one power adaptor 10 per solid state lighting unit 30, it is within the scope of the invention to have a power output module 14 which can provide multiple groups of independent electrical outputs which are capable of controlling a plurality of separate solid state lighting units 30.

The solid state lighting unit 30 may also be fitted with a conventional temperature sensor 40 which could monitor the temperature within an associated housing and provide the adaptor processor 13 with an overheat signal. The processor 13 would be programmed to instruct the power output module 14 to temporarily interrupt, or indefinitely isolate, power to the potentially overheating solid state lighting unit 30 until such time that the signal is cancelled or re-set.

Other embodiments are intentionally within the scope of the accompanying claims.

The invention claimed is:

1. A power adaptor for a lighting unit, comprising:

an input for coupling to an electrical power supply; and a controller adapted to monitor an amount of power available at the input and operable to provide at least two independent electrical outputs, each output having a power level that is a function of (i) the power presently available at the input and (ii) a lighting profile, said lighting profile comprising a transfer characteristic defining a relationship between the power available at the input and the independent electrical outputs;

wherein the controller is programmed to operate in response to movement of a dimmer control switch, the controller having at least two modes of operation, a first mode being in response to a conventional dimmer switch operation to gradually change a lighting intensity signal at least one of said two independent electrical outputs and wherein the controller is programmed in a second mode to select sequentially a successive one of a plurality of lighting profiles in response to movement of the dimmer control switch back and forth within a predetermined time interval.

2. The power adaptor as in claim 1, in which each independent electrical output is separately controllable to vary an intensity and/or color characteristic output of a solid state lighting unit.

3. The power adaptor as in claim 1, wherein the controller is operable to provide three independent electrical outputs, each having a power level which is functionally dependent on an amount of power available at the input.

4. The power adaptor as in claim 1, in which the at least two independent electrical outputs are pulse width modulated signals for supplying and controlling a solid state lighting unit.

5. The power adaptor as in claim 4, in which the pulse width modulated signals have substantially constant current or voltage levels.

6. The power adaptor as in claim 1, in which the controller comprises a power monitoring circuit adapted to monitor variations in the electrical power supply to determine an input duty cycle.

7. The power adaptor as in claim 6, in which the controller further comprises a processor coupled to the power monitoring circuit and adapted to output a control signal based on the input duty cycle.

8. The power adaptor as in claim 7, in which the processor is adapted to modify the control signal in response to a change in input duty cycle.

9. The power adaptor as in claim 7, in which the controller further comprises an output power module responsive to the processor control signal and operable to provide the at least two independent electrical outputs.

10. The power adaptor as in claim 9, in which the processor includes a plurality of lighting profiles to modify the at least two independent electrical outputs, each profile including a transfer characteristic defining a relationship between the power available at the input and the output power levels of the at least two independent electrical outputs.

11. The power adaptor as in claim 10, in which the processor is adapted to sequentially select a successive one of the lighting profiles whenever the power available at the input is at a fourth power level.

12. The power adaptor as in claim 11, in which the fourth power level is at a low but non-zero level and is insufficient to provide power for operation of a solid state lighting unit.

13. The power adaptor as in claim 9, in which the controller further comprises a power regulator coupled to the input and operable to supply electrical power to the output power module based on an amount of power available at the input, wherein the power regulator has an overall range of operation divided into (i) a first range over which the electrical power is varied between a first power level and a second power level and (ii) a second range over which the electrical power is held substantially constant at a third power level.

14. The power adaptor as in claim 13, in which the third power level is sufficient to provide power for operation of a solid state lighting unit and the first power level is insufficient to provide power for operation of a solid state lighting unit.

15. The power adaptor as in claim 13, in which the second power level is substantially the same as the third power level.

16. The power adaptor as in claim 13, in which the third power level corresponds to substantially 100% of mains voltage duty cycle and the first power level corresponds to a substantially reduced duty cycle.

17. The power adaptor as in claim 13, in which the second range comprises approximately 80% of the overall range.

18. An adaptor for supplying power to a lighting unit, comprising:

a sensing means for monitoring a duty cycle of an input received from a main power supply; and a control means responsive to the input duty cycle and operable to provide at least two independent electrical outputs, each having a duty cycle based on the input duty cycle each output having a power level that is a function of (i) the power presently available at the input and (ii) a lighting profile, said lighting profile comprising a transfer characteristic defining a relationship between the power available at the input and the independent electrical outputs;

wherein the control means is programmed to operate in response to movement of a dimmer control switch, the controller having at least two modes of operation, a first mode being in response to a conventional dimmer switch operation to gradually change a lighting intensity signal at least one of said two independent electrical outputs and wherein the controller is programmed in a second mode to select sequentially a successive one of a plurality of lighting profiles in response to movement of the dimmer control switch back and forth within a predetermined time interval.

19. The power adaptor as in claim 18, in which each independent electrical output is separately controllable and operable to control an intensity and/or color characteristic of a solid state lighting unit.

20. The power adaptor as in claim 18, in which the at least two independent electrical outputs are pulse width modulated signals for supplying and controlling a solid state lighting unit.

21. The power adaptor as in claim 20, in which the pulse width modulated signals have substantially constant current or voltage levels.

22. The power adaptor of claim 18 incorporated into a housing, in which the input comprises a bayonet- or screw-type male light fitting and the adaptor further includes a corresponding bayonet- or screw-type light socket.

23. The power adaptor of claim 22, further including at least one solid state lighting unit connected to the at least two independent electrical outputs, and mounted in or on the housing.

24. The power adaptor as in claim 18, in which the control means comprises a processor programmed to include a plurality of lighting profiles to modify the duty cycles of the at least two independent electrical outputs, each profile for determining a particular colour characteristic of a solid state lighting unit.

25. The power adaptor as in claim 24, in which the processor is adapted to sequentially select a successive one of the lighting profiles whenever the input duty cycle corresponds to a specific power level.

26. The power adaptor as in claim 25, in which the specific power level is a low, but non-zero, level which is insufficient to provide power for operation of a solid state lighting unit.

27. A lighting system comprising:

a solid state lighting unit including at least two separately controllable light emitters of different colours;

a lighting controller for controlling the output of an electrical power supply for the lighting unit:

and a power adaptor including: an input for receiving the output of the electrical power supply; and a controller adapted to monitor the input and operable to provide at least two independent electrical outputs, each output having a power level based on an amount of power available at the input; wherein each light emitter is adapted to receive a respective one of the electrical outputs to control an intensity and/or variable colour output characteristic of the lighting unit, said at least two independent electrical outputs having power levels that are a function of (i) the power presently available at the input and (ii) a lighting profile, said lighting profile comprising a transfer characteristic defining a relationship between the power available at the input and the independent electrical outputs;

wherein the controller is programmed to operate in response to movement of a dimmer control switch, the controller having at least two modes of operation, a first mode being in response to a conventional dimmer switch operation to gradually change a lighting intensity signal at least one of said two independent electrical outputs and wherein the controller is programmed in a second mode to select sequentially a successive one of a plurality of lighting profiles in response to movement of the dimmer control switch back and forth within a predetermined time interval.

28. The lighting system as in claim 27, in which the lighting controller includes a triac and/or thyristor dimming circuit.

29. The lighting system as in claim 27, in which the lighting controller includes a single control knob slidable or rotatable between first and second end points.

30. The lighting system as in claim 27, further comprising an incandescent lighting unit connected in parallel with the power adaptor and adapted to receive the output of the electrical power supply.

31. The lighting system as in claim 27, in which the lighting controller includes a sensor for receiving an input signal to control the output of the electrical power supply.

32. The lighting system as in claim 31, in which the sensor is any one of an infra-red sensor, an acoustic sensor and a wireless receiver.

33. The lighting system as in claim 31, in which the lighting controller further includes a processor responsive to the input signal and adapted to encode the electrical output in accordance with a pre-set sequence of output levels in response to the input signal.

34. The lighting system as in claim 33, in which the pre-set sequence of output levels includes one or more power levels corresponding to a power level which is insufficient to provide power for the solid state lighting unit.

* * * * *